US005117983A

United States Patent [19]

Marrs

[11] Patent Number: 5,117,983

[45] Date of Patent: Jun. 2, 1992

[54] BAR SCREEN HAVING A RECIPROCATING ACTION

[75] Inventor: Gevan R. Marrs, Puyallup, Wash.

[73] Assignee: Weyerhaeuser Company, Tacoma, Wash.

[21] Appl. No.: 390,620

[22] Filed: Aug. 7, 1989

[51] Int. Cl.[5] ..... B07B 1/16

[52] U.S. Cl. ..... 209/674; 209/393; 209/396

[58] Field of Search ..... 209/674, 660, 325, 326, 209/393, 365.2, 365.4, 396

[56] References Cited

U.S. PATENT DOCUMENTS

| | | | |
|---|---|---|---|
| 210,033 | 11/1878 | Herriott et al. | 209/674 X |
| 975,413 | 11/1910 | Gunn | 209/396 |
| 1,136,674 | 4/1915 | Houston | 209/674 |
| 2,311,169 | 2/1943 | Gordon et al. | 209/396 |
| 3,106,523 | 10/1963 | Couture | 209/396 X |
| 3,254,767 | 6/1966 | Wehner | 209/329 |
| 3,805,755 | 4/1974 | Bixby et al. | 209/395 |
| 3,971,716 | 4/1976 | Foreman | 209/396 |
| 4,240,588 | 12/1980 | Fulghum, Jr. | 209/674 X |
| 4,430,210 | 2/1984 | Tuuha | 209/672 X |
| 4,504,386 | 3/1985 | Dyren et al. | 209/396 X |
| 4,558,787 | 12/1985 | Danielsson | 209/396 X |
| 4,660,726 | 4/1987 | Woode | 209/674 |
| 4,664,790 | 5/1987 | Lundquist | 209/396 X |

FOREIGN PATENT DOCUMENTS

| | | | |
|---|---|---|---|
| 468403 | 9/1950 | Canada . | |
| 88615 | 12/1936 | Sweden | 209/396 |
| 1058639 | 12/1983 | U.S.S.R. . | |
| 1351698 | 11/1987 | U.S.S.R. . | |

*Primary Examiner*—Donald T. Hajec
*Attorney, Agent, or Firm*—Jensen & Puntigam

[57] ABSTRACT

A bar screen (10) for sizing wood chips which includes a plurality of parallel bars (12—12) supported at their respective ends (14, 16) in such a manner and driven in such a manner that each bar moves both longitudinally and vertically. Two alternating sets of bars (12—12) are included, one set being 180° removed in position relative to the other set. The speed and movement of the bars (12—12) is such that the wood chips are tipped up to a vertical orientation and supplied with such a momentum that the chips break contact with the bars and encounter a slot between adjacent bars in their thickness dimension.

9 Claims, 3 Drawing Sheets

BAR SCREEN HAVING A RECIPROCATING ACTION

DESCRIPTION

1. Technical Field

This invention relates generally to the particle sizing art, such as for wood chips, and more specifically concerns a bar screen particle sizing apparatus which includes at least two sets of movable bars, wherein the bars in each set move in unison 2. Background of the Invention In the sizing of wood chips for various purposes, such as pulping, it is well known to use a combination of gyratory and disc screens in order to accomplish the desired separation of wood chips into dimensionally acceptable and non-acceptable (typically over-thick) portions. The gyratory screen typically comprises a flat plate or sheet having holes of a selected size and dimension punched therein, while the disc screen comprises a plurality of closely spaced thin discs vertically mounted on successive horizontal rods. Each row of discs is interleaved to an extent with the discs from adjacent rows. The relative spacing of the discs in a single row and the spacing between successive rows of discs are selected relative to the sizing function being accomplished, i.e. the desired dimensions of the particles. An example of such a combined gyratory and disc screen system is shown and described in U.S. Pat. No. 4,376,042 to Brown.

Neither the gyratory screen alone, nor the disc screen alone are very efficient, and even the combination of the gyratory screen and the disc screen, with a combined efficiency of approximately 90%, still leaves significant room for improvement, and resulting cost savings. The gyratory screen is relatively inexpensive to manufacture and maintain, but as stated above, is so inefficient that it normally cannot be used by itself. The disc screen, while more efficient than the gyratory screen, is expensive to manufacture, construct and maintain. Approximately 75% of all current screen systems, however, comprise only a disc screen. Further, while the gyratory screen can be readily and inexpensively replaced or altered to change the screen surface openings after installation, disc screens are very difficult and expensive to alter once installed. In particular a change in the size of the disc screen openings basically requires replacement of the entire screen, which as mentioned above, is quite expensive. In addition, the disc screen elements will physically wear over time and will require replacement, which is expensive.

The combination of a gyratory screen and a disc screen, which is now fairly commonplace in the industry, minimizes many of the disadvantages of disc screens while maintaining the advantages of both the gyratory screen and the disc screen, but the combination still has some significant disadvantages both in efficiency and overall expense.

It would be most desirable to have a single sizing screen which is both efficient and inexpensive to manufacture, install and change if necessary. Toward that end, single screening devices known as bar screens have been developed. Bar screens typically comprise a plurality of longitudinal bars which are spaced apart a selected distance, depending upon the size of the particles to be processed. In certain applications, including chip sizing, it is known that relative movement of the bars is important for proper operation of bar screens, especially to avoid plugging, and further that the bar movement be such that alternate bars are always at different points in their individual cycles of movement so that there is always a relative difference in position of adjacent bars. Examples of bar screens having these capabilities are shown in U.S. Pat. No. 4,660,726 to Woode and Swedish Patent No. 88,615 to Granquist.

However, it has been well established that bar screens in general have significant plugging problems, i.e. the chips or other particles being processed by the screen become caught between the bars, preventing acceptable chips from falling through. As a result, bar screens are not widely used for particle sizing, including sizing of wood chips. Bar screens are also typically susceptible to an inability to tip up the particles being processed on edge so that sizing may be accomplished on the basis of thickness. Thickness sizing is currently used in sizing wood chips, and hence, bar screens are not used currently to size wood chips.

Hence, there is at the present time no inexpensive, easy to maintain, yet highly efficient screening apparatus for sizing wood chips and the like.

DISCLOSURE OF THE INVENTION

The invention is a bar screen adapted to separate wood chips and the like in accordance with preselected dimensional criteria comprising a plurality of elongated bars, defining slots therebetween, wherein the width of the slots is determined by the preselected dimensional criteria, means supporting the bars for movement thereof both longitudinally and vertically, and means for driving the supporting means at such a speed and in such a manner that the horizontal and vertical movement of the bars impart sufficient momentum to the chips that substantially all the chips tend to a vertical orientation and encounter a slot between two adjacent bars in its thickness dimension.

BEST MODE FOR CARRYING OUT THE INVENTION

Figure 1:
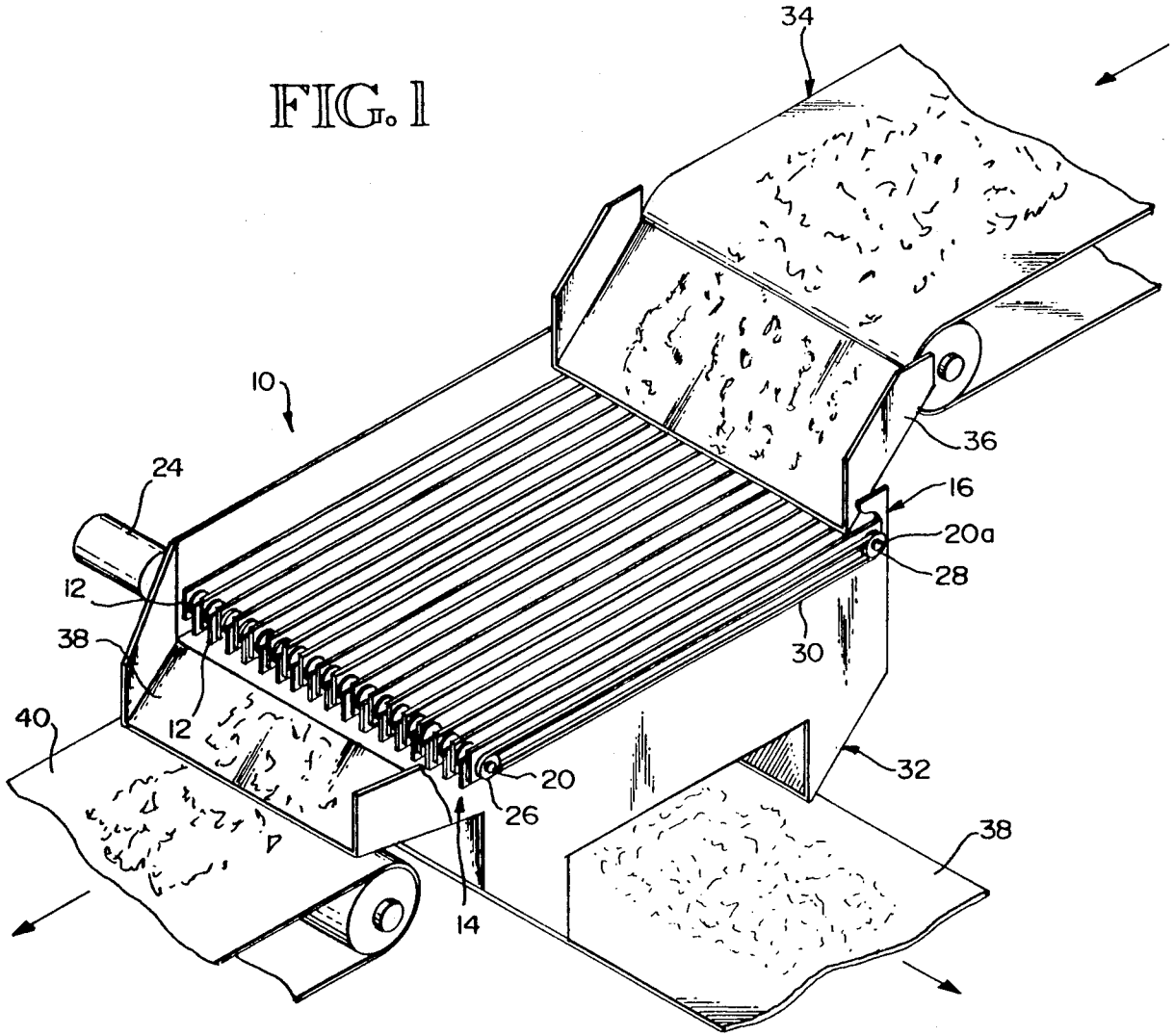
FIG. 1 is a schematic view of a particle (wood chip) sizing apparatus incorporating the principles of the present invention.

FIG. 1 shows the particle bar screen of the present invention, arranged to separate a wood chip flow into those chips which are within an acceptable preestablished size range and those chips which are oversize in the thickness dimension, i.e. over-thick. The bar screen is shown generally at 10 and comprises a plurality, i.e. 25–30, of parallel rigid metal bars 12—12. The details of the geometry of the bar screen 10 and the bars 12, i.e. length, width, thickness, number, material and relative spacing will vary significantly from apparatus to apparatus. A preferred embodiment is disclosed in detail hereinafter.

The successive individual bars 12—12 are supported by a cam and camshaft arrangement positioned at both the forward end 14 and rear end 16 of the bar screen 10.

In the embodiment shown, each bar 12 has a cam element 18 (FIG. 2) positioned in each end thereof. A camshaft 20 extends through an opening 21 in each cam element, thereby connecting the bars 12—12 together at their forward ends. A similar rear camshaft 20*a* connects the rear ends of the bars 12 in similar fashion. The opening 21 in the respective cam elements 18—18 is offset from the center of the cam element and is configured to receive the camshaft 20, which is square in cross section, so that rotation of the camshaft 20 will result in movement of the bars 12—12. In the embodiment shown, the arrangement of the camshaft 20, the cam element 18 and the bars 12 is such that each point on the bar will move in a circle approximately one inch in diameter. Thus, for instance, the upper front corner of bar 12 will move vertically a total of one inch and horizontally a total of one inch during one complete revolution of camshaft 20.

In the embodiment shown, the individual bars 12—12 are separated by spacers 22—22, with the camshaft 20 extending through an opening 23 in the spacers 22—22. The details of the cam elements 18, shaft 20, and spacers 22 are discussed hereinafter. A drive motor 24 is connected to the camshaft 20. The free end of camshaft 20, which is relatively away from the drive motor 24, includes a sprocket 26. The rear camshaft 20*a* also includes a sprocket 28 on one end thereof, on the same side of the bar screen 10 as sprocket 26, so that sprockets 26 and 28 are in the same plane. Sprockets 26 and 28 are connected by a chain 30 so that when camshaft 20 is driven by drive motor 24, the rear camshaft 20*a* is driven as well.

In the embodiment shown, the bar screen 10 is supported on a base assembly shown generally at 32 which is open at its top, where the bar screen 10 is located. A conventional feed conveyer 34 moves particles to be sorted onto a downwardly inclined feed tray 36, which connects the feed conveyor 34 to the rear end 16 of the bar screen 10. At the bottom of the base element 32, beneath the bar screen 10, is an "accepts" conveyor 38 which moves those particles which have fallen through the bar screen 10 in operation thereof, and hence have dimensions in the acceptable range, to a desired destination, such as the input to a pulping station or to storage. At the forward end 14 of bar screen 10 is an outlet tray 38 which guides the chips remaining on top of the bar screen 10 during operation thereof, when they reach the forward end 14 of the bar screen 10, to an over-thick conveyor 40. The conveyor 40 moves the over-thick chips to a slicer or other device (not shown) for reducing the size of the chips or to some other destination.

Typically, but not necessarily, bar screen 10 is supported so that it is flat in the embodiment shown. However, the bar screen 10 could be inclined downwardly, which would assist in the conveying, i.e. movement, of the chips from the rear end to the forward end of the bar screen 10, or the bar screen 10 could be inclined in the other direction, i.e. upwardly, in a particular application. The precise amount of the incline, of course, can be selected for a particular application.

Figure 2:
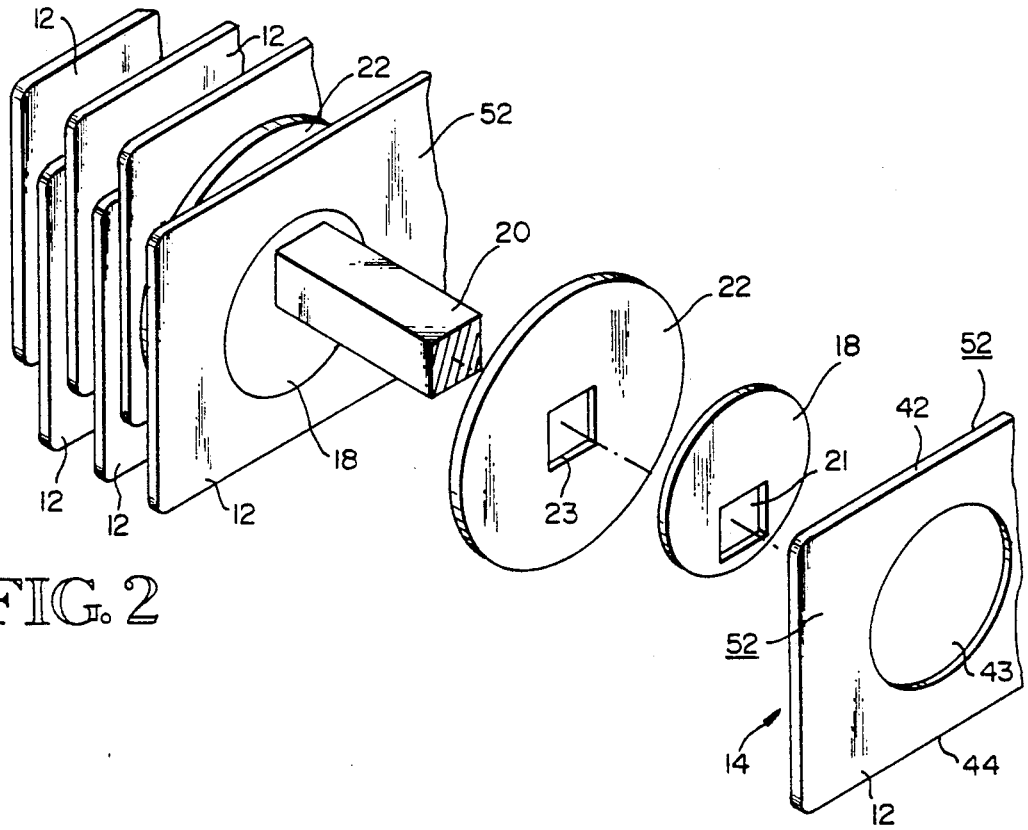
FIG. 2 is a schematic view showing an end portion of several bars in the bar screen of FIG. 1 and the means for supporting and moving the bars.

The details of the bar screen 10, in particular an embodiment of the structure for supporting and moving the bars 12—12, is shown in FIGS. 2 and 3 A portion of the plurality of bars 12—12 comprising the bar screen 10 is shown in FIG. 2. Each bar 12 includes a cam element 18 near the front end thereof. In the embodiment shown, the cams 18 are circular and fit into a mating cutout portion 43 in a bar 12. In the embodiment shown, the bars 12—12 are rectangular and relatively thin, approximately ¼ inch thick. Generally, the thickness of the bars 12—12 is the minimum thickness which will result in an acceptable amount of deflection at the midspan point of the bars.

In the embodiment shown, the thickness dimension of the bars remains constant from the top edge 42 of the bar to the bottom 44 thereof. This appears to be the most effective cross-sectional shape, since it is easy to manufacture and inexpensive to replace. Other cross sectional shapes could be used, including elliptical, or round, or the bars could be inversely wedge-shaped with the large dimension at the top, or still further, the upper portion of the bar could be peaked so as to tip up the chips more effectively.

In the embodiment shown, the top surface 42 of each bar is smooth and flat. However, it could be roughened to some extent, or knurled or even have teeth of a selected size, to assist in the movement and agitation of the material being screened. The teeth could be relatively small, i.e. one-quarter inch, up to two inches high or more. The side surfaces 52 of each bar 12 may also have some contour or be abraded to some extent. In the embodiment shown the sides of adjacent bars are parallel, such that successive slots, defined by adjacent bars, have the same width from top to bottom. The slots, however, may also have other shapes, including a configuration in which the space between bars increases from top to bottom, which could be accomplished by using tapered bars.

Referring still specifically to FIGS. 2 and 3, camshaft 20 extends through each one of the cams 18 positioned in the bars 12. In the embodiment shown the camshaft 20 is square in cross-section, but could also have other shapes. The cam 18 is positioned midway between the top and bottom edges of each bar 12. As mentioned above, the camshaft is offset from the center line of the bar so as to give the amount of bar movement desired. Positioned between the successive bars are spacers 22 which in the embodiment shown are circular, having a diameter slightly greater than the height of bars 12—12 and approximately the same thickness. The thickness of the spacer is independent of the thickness of the bar and is typically chosen to produce a slot width which will produce the desired particle separation. The slot width is slightly smaller than the desired particle size, i.e. thickness, due to midspan deflection of the bars. The camshaft 20 extends through a matching hole 23 in each spacer 22. In the embodiment shown, the cams and spacers comprise a low-friction, high wear plastic material, such as DELRIN, but could also alternatively comprise sealed roller bearings or other low friction materials or elements. The spacers shown have the advantage of being easy and inexpensive to disassemble in the field to replace worn bars and/or change spacer size so as to change the screen slot width and hence particle separation.

The position of the cams 18 and in particular the openings 21 therein in the bars 12 determine the magnitude of movement of individual bars relative to the camshaft 20. The relative positioning of the cams 18 in successive bars then determines the movement of the bars relative to each other. For instance, in the embodiment shown, there are in effect two sets of alternating bars with each set comprising half the bars in the screen 10. Both sets of bars follow the same path of movement, however, the opening 21 in the cams 18 of one set of bars in the embodiment shown is 180° removed from the openings in the other set of cams so that the position of one set of bars will be exactly 180° removed from the position from the other set of bars at any one time. In the embodiment shown, the bars from the two sets are arranged in alternating succession. As shown in FIG. 2, the cams 18 in one set of bars are at their highest position, so that the bars of that set are all high, while the cams in the other set (alternating with first set) are all low so that the bars of the other set are all low. This results in a high, low, high, low, etc. bar pattern, as shown in FIG. 2. While the embodiment shown comprises two sets of alternating bars at 180°, the screen 10 could comprise 3 or even more sets of alternating bars, although the sets should be balanced relative to each other (3 sets at 120°, 4 sets at 90° etc.), so as to minimize vibration and wear on bearing surfaces.

FIGS. 3A–3D show the concept of relative movement of the two sets of bars of the present embodiment in a more detailed manner. A first bar 66 is shown with its cam 68, as well as a second adjacent bar 70 with its cam 72. A spacer 74 separates the two bars 66 and 70. Camshaft 76 extends through cams 68 and 72 and the spacer 74. Camshaft 76 is fixed in position, other than rotating counter-clockwise. Hence, movement of the two bars 66,70 is about the camshaft 76.

Figure 3A:
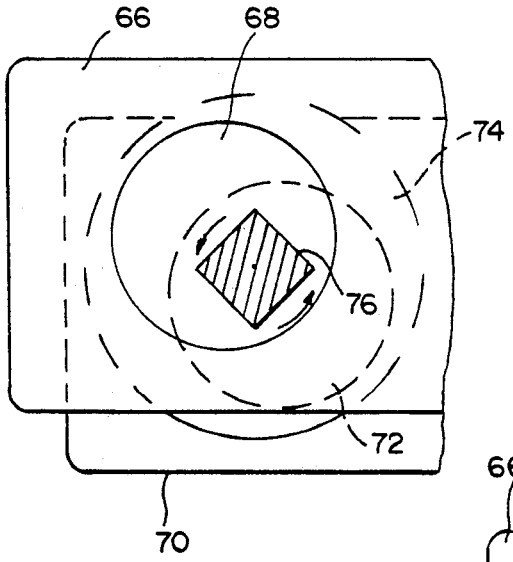
FIGS. 3A–3D are side elevational views showing the relative movement at various points in time of the end portions of two adjacent bars in the bar screen of FIG. 1.

FIG. 3A shows camshaft 76 at a first rotational position, in which the first bar 66 is in a relatively forward and relatively high position while bar 70 is in a relatively low and rear position. The two bars are exactly 180° out of phase, because the cams are positioned in the bars such that the respective openings therein are 180° apart.

Figure 3B:
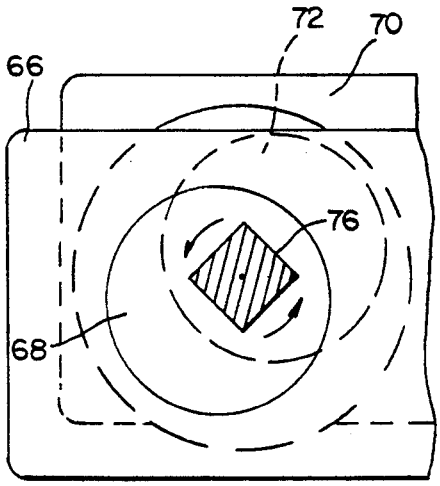

FIG. 3B shows the relative position of the two bars 66 and 70 following movement of the cam shaft 76 90° in a counter-clockwise direction. In this position, the first bar 66 is in a still relatively forward but now relatively low position in its path of movement while bar 70 is still relatively to the rear but also now relatively high.

Figure 3C:
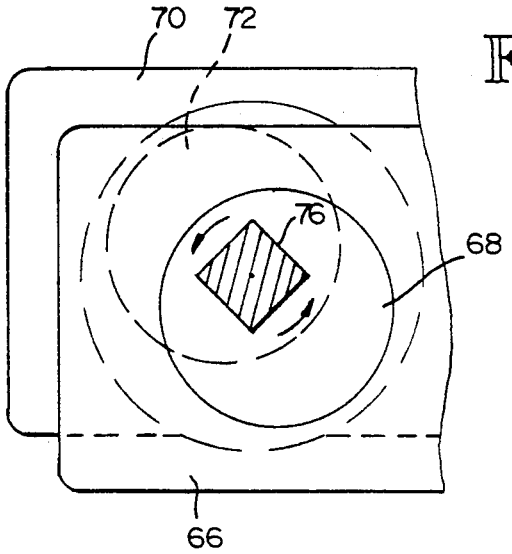

FIG. 3C shows the relative position of the two bars 66 and 70 when the camshaft 76 has moved another 90° counter-clockwise. In this position of the camshaft, the first bar 66 is now relatively to the rear and still relatively low, while the bar 70 has now moved to a forward position and is still relatively high.

Figure 3D:
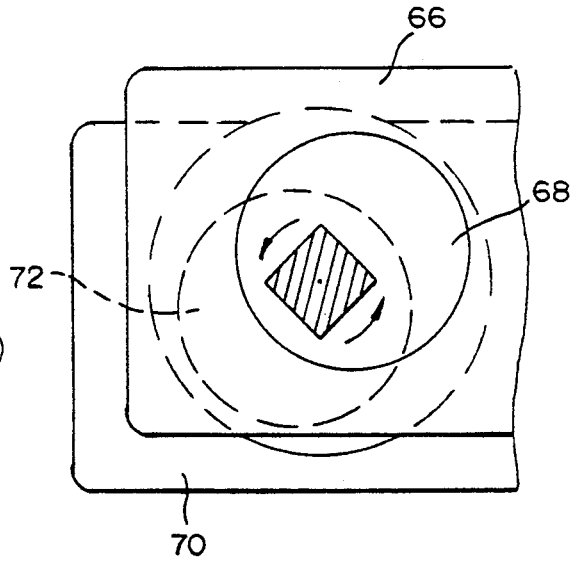

FIG. 3D shows the relative position of the bars 66 and 70 upon further rotation of the camshaft another 90°. In this position, the first bar 66 is still relatively to the rear but is now relatively high, while bar 70 is still relatively forward but now is relatively low as well. Another 90° rotation of the camshaft will bring the two bars 66,70 back to the position of FIG. 3A.

As indicated above, it is important that there be both vertical and horizontal relative motion between the bars comprising the bar screen. This helps to tip the chips upwardly on edge so as to present the thickness dimension of the chips to the slots and keeps the screen from plugging The range of motion, in particular the vertical component of the movement, could be anywhere from 1/16th inch to 3 inches, although a range of ¾ inch to 1½ inch would be typical for wood chips.

In the embodiment shown there are, as indicated above, two separate sets of bars which comprise the bar screen 10, with bars of one set alternating with bars of the other set. Referring to FIGS. 3A–3D, bar 66 is representative of the movement of all the bars in one set, while bar 70 is representative of the movement of all the bars in the other set. However, it should be understood that other bar movement patterns could be used, including non-alternating sets, such as two consecutive bars up, two consecutive bars down, or other patterns In addition, as mentioned above, there could be more than two sets of bars, positioned at balanced angular intervals.

It should be noted that in the embodiment shown, the motion of the bars 12 is such that both ends of the bars 12 are always in the same relative vertical position, i.e. the respective ends of each bar always move in tandem, i.e. unison, as opposed to the relative position of the bar ends changing on a regular basis. Patterns of bar motion can be produced in which the incline or slope of the bar will vary on a cyclical basis. Still further, different types of bar drive devices could be utilized such that the ends of the bar will follow a different path than the circular path of the embodiment shown.

Also, different driving systems could be used for the bars. For instance, the two sets of bars could be supported on two separate frames, with the frames then driven by separate cams. A single cam could also be used with a connecting arm to the frame.

The inventor has discovered that the relative movement of the bars and the speed of the bars are both important to achieve effective screening action, keep the screen clear and prevent plugging. Movement of the bars alone is not sufficient to prevent plugging. In the embodiment shown, the speed of the bars as well as the horizontal and vertical movement of the bars are such in combination that sufficient acceleration is imparted to the wood chips lying on top of the screen that the chips move about on the bar screen and encounter a slot between two adjacent bars. Usually, the acceleration will be approximately 1 G (32 feet per second per second) or slightly greater, such that the chips will just break contact with the bars at some point (overcome gravity) and will tend to become vertically oriented as they encounter a slot. In the embodiment shown, a camshaft speed of 228 RPM is sufficient to achieve the desired results by imparting sufficient acceleration to the wood chips that the chips move about on the bar screen, the chips tending to be tipped up on edge and fall between adjacent bars, thereby encountering a slot in the screen. It is the combination of both vertical and horizontal motion of the bars and sufficient speed thereof which has been found to be effective.

Hence, an apparatus has been described which is capable of performing particle sizing, such as for wood chips, in a practical and efficient way. The bar screen of the present invention is inexpensive to manufacture and maintain, particularly compared to conventional disc screens, and furthermore is very efficient when compared to either a disc screen or gyratory screen alone, but also the combination of a gyratory screen and a disc screen. Over-thick removal efficiencies of approximately 96% have been obtained.

Although an embodiment of the invention has been disclosed herein for illustration it should be understood that various changes, modifications and substitutions may be incorporated in such embodiment without departing from the spirit of the invention which is defined by the claims which follow:

What is claimed is:

1. A bar screen adapted to separate wood chips in accordance with preselected dimensional criteria, comprising:

a plurality of elongated bars, defining slots therebetween, wherein each of the bars includes a cutout portion at each end thereof and a cam element positioned in each cutout portion and wherein the width of the slots is determined by the preselected dimensional criteria;

means supporting said bars for movement thereof both longitudinally and vertically, including a camshaft which extends through the cam elements in each of the bars;

means for driving said supporting means at such a speed and in such a manner that the horizontal and vertical movement of the bars imparts sufficient momentum to the chips that substantially all the chips tend to a vertical orientation and encounter a slot between two adjacent bars in their thickness dimension, said driving means including a motor for rotating the camshafts, wherein rotation of the camshafts results in movement, both horizontal and vertical, of the bars, the bars being furthermore so supported that the respective ends of each bar move in unison during movement thereof.

2. An apparatus of claim 1 wherein the momentum imparted to the chips is such that substantially all the chips break contact with the bars at some point in time.

3. An apparatus of claim 1, wherein the bars are elongated, generally rectangular, and plate-like in configuration, having substantially the same thickness from upper edge to lower edge thereof.

4. An apparatus of claim 1, including spacer elements which are positioned between successive bars.

5. An apparatus of claim 1, wherein the individual cams are positioned and configured relative to the bars such that there are at least 2 sets of bars, wherein bars comprising each set move in unison with the other bars in said each set.

6. An apparatus of claim 1 wherein bars comprising one set alternate with bars comprising the other set.

7. An apparatus of claim 6, wherein the bars in each set follow the same path of movement in unison and wherein the position of those bars in one set is always approximately 180° removed from the position of those bars in the other set.

8. An apparatus of claim 1 wherein the bars are supported such that the respective ends of each bar move in unison.

9. An apparatus of claim 1 wherein the bars have a range of vertical movement between $\frac{3}{4}''$ and $1\frac{1}{2}$ and wherein the bars have a speed of approximately 228 RPM.

* * * * *

UNITED STATES PATENT AND TRADEMARK OFFICE

CERTIFICATE OF CORRECTION

PATENT NO. : 5,117,983

DATED : June 2, 1992

INVENTOR(S) : Gevan R. Marrs

It is certified that error appears in the above-identified patent and that said Letters Patent is hereby corrected as shown below:

Column 8, line 10:

Claim 6 should depend from claim 5, instead of claim 1.

Signed and Sealed this

Twenty-first Day of September, 1993

Bruce Lehman

*Attest:*

BRUCE LEHMAN

*Attesting Officer*

*Commissioner of Patents and Trademarks*